US005103656A

United States Patent [19]

Hanson, II

[11] Patent Number: 5,103,656

[45] Date of Patent: Apr. 14, 1992

[54] SPLIT-HEEL SOCK

[75] Inventor: Norman M. Hanson, II, Rockford, Ill.

[73] Assignee: NK Mills, Inc., Rockford, Ill.

[21] Appl. No.: 499,778

[22] Filed: Mar. 27, 1990

[51] Int. Cl.[5] ..... A41B 11/00

[52] U.S. Cl. ..... 66/185; 2/239

[58] Field of Search ..... 2/239; 66/178 A, 184, 66/185, 186, 187

[56] References Cited

U.S. PATENT DOCUMENTS

| | | | |
|---|---|---|---|
| 412,056 | 10/1889 | Young | 66/184 |
| 2,013,396 | 9/1935 | Adamson | 66/184 X |
| 2,050,535 | 8/1936 | Martel | 66/178 A |
| 2,102,368 | 12/1937 | Martel | 66/185 |
| 2,218,413 | 10/1940 | Bell | 66/178 A |
| 2,219,235 | 10/1940 | Morton | 2/239 |
| 3,098,369 | 7/1963 | Burleson et al. | 66/178 A |
| 3,241,340 | 3/1966 | Knohl | 66/185 |
| 3,443,404 | 5/1969 | Knohl | 66/185 X |
| 3,546,900 | 12/1970 | Knohl | 66/185 |
| 4,732,015 | 3/1988 | Abrams et al. | 66/185 X |

FOREIGN PATENT DOCUMENTS

| | | | |
|---|---|---|---|
| 265395 | 4/1988 | European Pat. Off. | 2/239 |
| 545153 | 5/1942 | United Kingdom | 66/185 |

*Primary Examiner*—Peter Nerbun
*Assistant Examiner*—John J. Calvert
*Attorney, Agent, or Firm*—David H. Judson

[57] ABSTRACT

A sock includes an integral leg and foot knit throughout of at least one body yarn, the leg and foot including a front half having a front leg portion and an instep portion, and a rear half including a rear leg portion, a heel portion and a sole portion. A stabilizing band of elastic yarn, e.g., LYCRA ®, is laid-into, or knit in a plated relationship with, the body yarn and extends from the top of the wear's instep around an apex of the heel portion such that in use the stabilizing band prevents the leg of the sock from sliding down the wearer's leg into the ski boot. A method of manufacturing the "split-heel" construction uses a circular hosiery knitting machine having short, medium and long butt needles. The needles are selectively lifted out of and/or dropped into the knitting track of the machine to form the split-heel.

6 Claims, 1 Drawing Sheet

SPLIT-HEEL SOCK

TECHNICAL FIELD

The present invention relates generally to hosiery and methods of manufacture therefor and more particularly to an improved sock construction having a split-heel for preventing sock ride-down.

BACKGROUND OF THE INVENTION

Ski sock constructions are well known in the prior art. It is quite common for such prior art ski sock constructions to "ride-down" the wearer's leg during use. This is due to opposing horizontal and vertical forces generated by the foot and leg portions of the sock which create a maximum stress on the sock material running through the apex of the heel. The horizontal stretch of the foot causes the leg portion of the sock to be pulled down into the wearer's boot. The sock then becomes uncomfortable for the wearer and does not adequately cushion the wearer's leg.

It would therefore be desirable to provide an improved ski sock construction wherein ride-down of the sock on the wearer's leg is avoided.

BRIEF SUMMARY OF THE INVENTION

It is an object of the present invention to provide a novel "split-heel" sock particularly adapted for use as a ski sock.

It is yet another object of the present invention to provide an improved heel construction for a sock that substantially prevents sock "ride-down" during use.

It is yet a further object of the invention to use a split-heel design in a ski sock for separating the sock into essentially independent horizontal and vertical sections, thus stabilizing the sock against movement while in use.

It is still another object to provide a simple and economical method of manufacturing socks having the novel split-heel design.

These and other objects of the invention are provided in accordance with the present invention which describes a split-heel sock construction and method of manufacture therefor.

Preferably, the sock comprises an integral leg and foot knit throughout of at least one body yarn, the leg and foot including a front half having a front leg portion and an instep portion, and a rear half including a rear leg portion, a heel portion and a sole portion. According to the invention, a stabilizing band of elastic yarn, e.g., LYCRA®, is either laid-into, or knit in a plated relationship with, the body yarn and extends from the top of the wearer's instep around an apex of the heel portion such that in use the stabilizing band prevents the leg of the sock from sliding down the wearer's leg into the ski boot.

The sock preferably also includes first and second ankle bands of elastic yarn laid or knit in a plated relationship with, the body yarn. The first ankle band is integral with an upper edge of the stabilizing band adjacent the top of the wearer's instep and extends around the leg of the sock above the heel portion. The second ankle band is integral with a lower edge of the stabilizing band adjacent the top of the wearer's instep and extends around the foot of the sock below the heel portion. The first and second ankle bands thus form a substantially inverted Y-shape.

In accordance with yet a further feature of the invention, a method of manufacturing a sock having a split-heel design is described. The method uses a circular hosiery knitting machine having short, medium and long butt needles, a knitting track, and conventional means for lifting and/or dropping selected needles in and/or out of the knitting track. The method, which begins as the knitting machine is knitting on all needles in a forward motion when the heel portion of the sock is reached, preferably comprises the steps of:

a) lifting substantially all of the long butt needles out of the knitting track while maintaining the short and medium butt needles in the knitting track;

b) placing the knitting machine into reciprocating motion and lifting one medium butt needle out of the knitting track per revolution of the machine until substantially all of the medium butt needles have been lifted out of the knitting track;

c) placing the knitting machine back into forward motion and lowering substantially all medium and long butt needles back into the knitting track;

d) knitting on substantially all needles for a predetermined number of revolutions of the knitting machine to create the stabilizing band;

e) lifting substantially all of the medium and long butt needles out of the knitting track while maintaining the short butt needles in the knitting track;

f) placing the knitting machine back into reciprocating motion and dropping one medium butt needle into the knitting track per revolution until substantially all of the medium butt needles have been dropped into the knitting track; and g) placing the knitting machine back into forward motion and lowering substantially all medium and long butt needles back into the knitting track.

The foregoing has outlined some of the more pertinent objects of the present invention. These objects should be construed to be merely illustrative of some of the more prominent features and applications of the invention. Many other beneficial results can be attained by applying the disclosed invention in a different manner of modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts or steps throughout the several views of the drawings.

DETAILED DESCRIPTION

Figure 1:
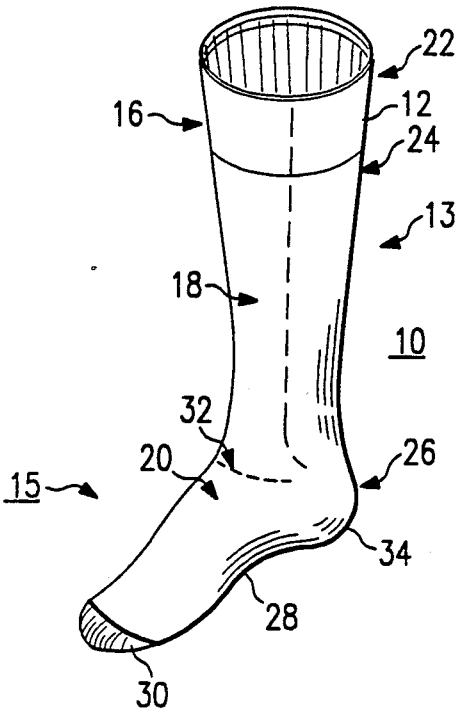
FIG. 1 (PRIOR ART)
FIG. 1 is a perspective view of a ski sock of the prior art as it appears when positioned on the leg and foot of the wearer.

Referring now to FIG. 1, a conventional ski sock 10 includes an upper cuff 12 that is integrally knit with an upper portion of a sock leg 13. The leg 13 is integrally knit with a foot 15. The sock includes a front half 16 having a front leg portion 18 and an instep portion 20, and a rear half 22 having a rear leg portion 24, a heel portion 26, and a sole portion 28. The sock also includes a conventional toe portion 30. The top of the instep portion 20 is designated generally by the reference numeral 32 and the heel portion 26 includes an apex 34 as will be described in more detail below. As is well known in the prior art, the leg 13 and foot 15 of the sock are knit throughout of at least one body yarn, such as nylon. Sock 10 may also include additional yarn knit in a plated relationship with the body yarn to form one or more thickened fabric areas where additional padding is needed. For example, terry loops or the like can be knit in the shin area, i.e., in the front leg portion 18, for cushioning and protecting the wearer's leg from discomfort caused by a ski boot. Other areas of the sock may also include such additional yarn.

The sock 10 of FIG. 1 is preferably formed on a well-known circular hosiery knitting machine having a circle of needles and a knitting track, and an appropriate mechanism for lifting and/or dropping selected needles in and/or out of the knitting track during operation. One such machine is available from H. E. Crawford Manufacturing and is identified by the name Concept Heritage System. Of course, other types of circular hosiery knitting machines can be used as well to accomplish the objects of the invention.

In the construction of a prior art sock such as seen in FIG. 1, the knitting machine is fitted with short and long butt needles and normally knits in a forward direction to produce the leg and foot. When it is desired to form the heel portion of the sock, a needle raising cam mechanism is activated to raise the long butt needles out of the knitting track. The machine is then placed in a reciprocating mode of operation. Once every revolution, one short butt needle is lifted out of the knitting track and this operation is continued until a predetermined number of the short butt needles have been lifted. The knitted fabric is thus progressively narrowed to form a first half of a heel pouch that terminates along a "gore" line running through the apex of the heel. A second half of the heel pouch is then formed by dropping one short butt needle per revolution back into the knitting track to thus progressively widen the knitted fabric. This operation continues until the second half of the heel pouch is symmetrical with the first half. The machine is then clutched out of reciprocation and the long butt needles are then lowered back into the track. Knitting then resumes on all needles.

Figure 2:
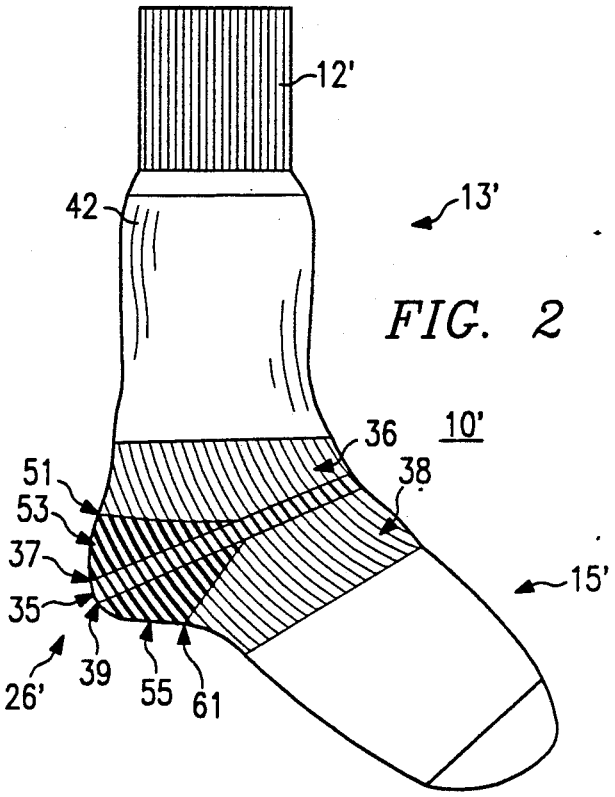
FIG. 2 is a side view of the split-heel sock construction according to the teachings of this invention.
Figure 2A:
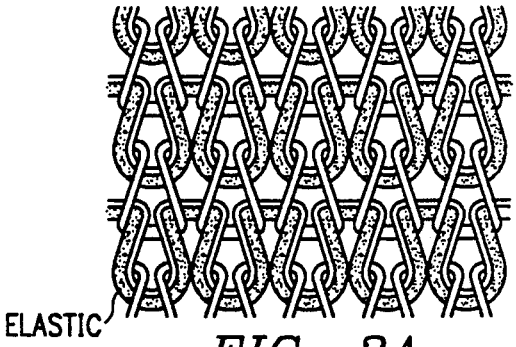
FIG. 2A is an enlarged stitch diagram of elastic yarn laid-into a body yarn.
Figure 2B:
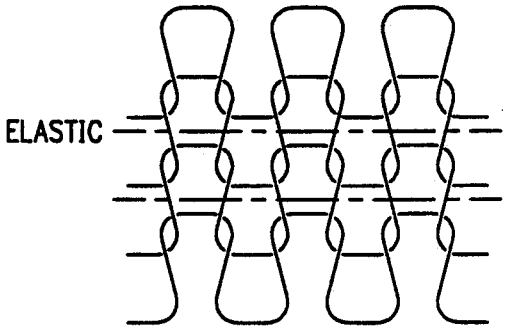
FIG. 2B is an enlarged stitch diagram of elastic yarn plated to the body yarn.

As is well known, it is quite common for prior art ski sock constructions such as shown in FIG. 1 to "ride-down" the wearer's leg during use. Referring now to FIG. 2, the problem of sock "ride-down" is overcome by providing a novel "split-heel" construction in a sock wherein a stabilizing band 35 of elastic yarn is formed with the body yarn and extends from the top of the wearer's instep around an apex of the heel portion. The band is formed preferably by being "laid" into the body yarn as shown in FIG. 2A, although the band may alternatively be "knit" in a plated relationship with the body yarn if desired as shown in FIG. 2B. As seen in FIG. 2, the sock 10' includes a leg 13' and foot 15' as described above with respect to FIG. 1. The leg and foot comprise a front half 16' having a front leg portion 18' and an instep portion 20', and a rear half 22' having a rear leg portion 24', a heel portion 26' and a sole portion 28'. Preferably, the band 35 is formed of LYCRA®, SPANDEX® or some similar elastic material. In use, the stabilizing band 35 advantageously cuts the sock into two independently operating sections. The band then acts as a stabilizer between opposing horizontal and vertical forces which normally act on the heel portion to cause ride-down. When the sock 10' is configured as a ski sock, the stabilizing band thus prevents the sock from pulling itself down and sliding into the wearer's ski boot.

As also seen in FIG. 2, the sock 10' preferably includes first and second ankle bands 36 and 38 of elastic yarn laid-into, or knit in a plated relationship with, the body yarn. The first ankle band 36 is integral with an upper edge 37 of the stabilizing band 35 adjacent the top of the wearer's instep 32 and extends around the leg 13' above the heel portion 26'. The second ankle band 38 is integral with a lower edge 39 of the stabilizing band adjacent the top of the wearer's instep 32 and extends around the foot 15' below the heel portion 26'. The first and second ankle bands 36 and 38 thus form a substantially inverted Y-shape.

The cuff portion 12' is preferably formed of a true rib or mock rib construction. The sock may also include additional yarn 42 knit in a plated relationship with the body yarn and extending around the front and rear leg portions of the leg. A padded shin guard (not shown) may also be formed in all or part of the leg 13 in a conventional manner if additional shin padding is required.

Figure 3:
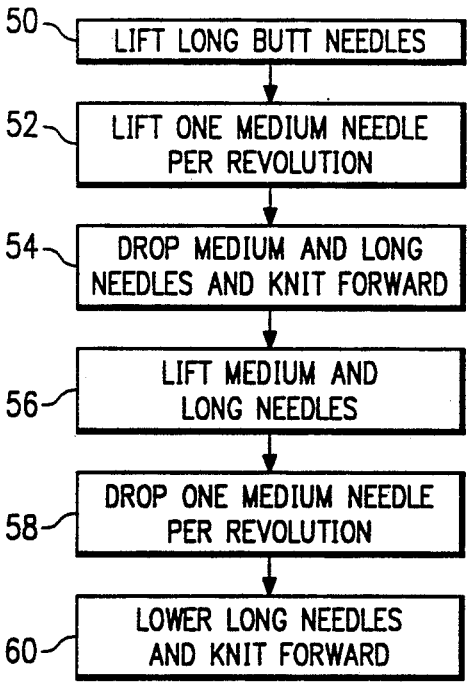
FIG. 3 is a flowchart showing a preferred method according to the invention for manufacturing the split-heel sock of FIG. 2.

According to the teachings of the present invention, a method is also provided for manufacturing the split-heel sock of FIG. 2. This method is described by the flowchart of FIG. 3, and requires the knitting machine to be fitted with three types of needles, short, medium and long butt needles. According to the method, a "split-heel" is formed by using the three lengths of needles and controlling the selective placement of such needles in the knitting track. At step 50, corresponding to the top 51 of the heel portion, the long butt needles are lifted out of the knitting track and the short and medium butt needles are retained therein. Prior to step 50, the knitting machine had been knitting in a forward direction on substantially all needles. At step 52, the machine is clutched into reciprocationon and one medium butt needle is "lifted" out of the knitting track per revolution until substantially all medium butt needles are lifted. During the progressive lifting of the medium butt needles at step 52, the machine continues to knit on the short butt needles. This operation creates a first rhomboid-shaped area 53 as shown in FIG. 2.

At step 54, all of the medium and long butt needles are dropped back down into the knitting track and the machine is placed back into forward motion and knitting continues on all needles. This operation advantageously creates the stabilizing band 35 extending from the top of the wearer's instep around an apex of the heel portion as described above with respect to FIG. 1. Preferably, the stabilizing band is created using up to eight (8) revolutions and includes the upper edge 37 and lower edge 39. After the band is formed, the method continues at step 56 wherein the long and medium butt needles are lifted out of the knitting track while the short butt needles remain. At step 58, the machine is clutched back into reciprocation, and one medium butt needle is then "dropped" into the knitting track per revolution until substantially all medium butt needles are dropped. During the progressive dropping of the medium butt needles at step 58, the machine continues to knit on the short butt needles. This operation creates a second rhomboid-shaped area 55 as best seen in FIG. 2.

At step 60, corresponding to the bottom 61 of the heel portion, the machine clutches into forward motion, a lowering cam lowers all long butt needles back into the track and the machine continues knitting on all needles. Steps 50, 52, 54, 56, 58 and 60 thus create a split-heel with the two rhomboid-shaped pouches 53 and 55 instead of the normal pouch created during prior art heel constructions. Each pouch narrows as it approaches the stabilizing band. The pouches are thus mirror images of themselves and are separated by the band 35 of normal circular knitting, i.e., knitting done on all needles. This construction effectively isolates the foot from the leg, thereby preventing sock "ride-down" on the leg and maintaining the sock on the wearer's foot.

It should be appreciated by those skilled in the art that the specific embodiments disclosed above may be readily utilized as a basis for modifying or designing other structures for carrying out the same purposes of the present invention. It should also be realized by those skilled in the art that such equivalent constructions do not depart from the spirit and scope of the invention as set forth in the appended claims.

What is claimed is:

1. In a sock particularly for wear with a ski boot and being knit throughout of at least one body yarn and including an integrally knit leg and foot, the leg and foot comprising a front half including a front leg portion and an instep portion, and a rear half including a rear leg portion, a heel portion and a sole portion, the improvement comprising:

a stabilizing band of elastic yarn laid-into the body yarn and extending from an upper juncture, between the leg portion and the foot, around an apex of the heel portion such that in use the stabilizing band prevents the leg of the sock from sliding down into the ski boot.

2. The sock as described in claim 1 further including a first ankle band of elastic yarn formed with the body yarn.

3. The sock as described in claim 2 wherein the first ankle band is knit in a plated relationship with the body yarn and is integral with an upper edge of the stabilizing band adjacent the front leg portion and extends around the leg above the heel portion.

4. The sock as described in claim 2 further including a second ankle band of elastic yarn formed with the body yarn.

5. The sock as described in claim 4 wherein the second ankle band is knit in a plated relationship with the body yarn and is integral with a lower edge of the stabilizing band adjacent the instep portion and extends around the foot below the heel portion.

6. A sock, comprising:

an integral leg and foot knit throughout of at least one body yarn, the leg and foot comprising a front half including a front leg portion and an instep portion, and a rear half including a rear leg portion, a heel portion and a sole portion;

a stabilizing band of elastic yarn formed with the body yarn and extending from an upper juncture, between the leg portion and the foot, around an apex of the heel portion;

first and second ankle bands of elastic yarn formed with the body yarn, the first ankle band adjacent the front leg portion and extending around the leg above the heel portion, the second ankle band adjacent the instep portion and extending around the foot below the heel portion such that the first and second ankle bands form a substantially inverted Y-shape.

* * * * *